United States Patent [19]

Gailey

[11] Patent Number: 4,494,346

[45] Date of Patent: Jan. 22, 1985

[54] CEILING SYSTEM AND PANEL-SECURING DEVICE THEREFOR

[75] Inventor: J. Lynn Gailey, Newton Falls, Ohio

[73] Assignee: Alcan Aluminum Corporation, Cleveland, Ohio

[21] Appl. No.: 438,532

[22] Filed: Nov. 1, 1982

[51] Int. Cl.[3] ..... E04B 5/52

[52] U.S. Cl. ..... 52/489; 52/665; 52/713

[58] Field of Search ..... 52/483, 484, 489, 479, 52/660, 664, 665, 667, 712–714

[56] References Cited

U.S. PATENT DOCUMENTS

| | | | |
|---|---|---|---|
| 3,209,505 | 10/1965 | Vermeulen et al. | 52/489 |
| 3,295,284 | 1/1967 | Tschiesche | 52/484 |
| 3,512,818 | 5/1970 | Pechenik | 52/713 |
| 3,640,033 | 2/1972 | Rijnders | 52/36 |
| 3,774,024 | 11/1973 | Deaton | 52/484 |

FOREIGN PATENT DOCUMENTS

| | | | |
|---|---|---|---|
| 967347 | 8/1964 | United Kingdom | 52/483 |

*Primary Examiner*—James L. Ridgill, Jr.

*Attorney, Agent, or Firm*—Cooper, Dunham, Clark, Griffin & Moran

[57] ABSTRACT

In a ceiling system wherein a plurality of horizontal C-shaped panels are carried by stringers extending above the panels, a device for securing a panel to a stringer at any desired angle relative thereto. The device includes a carrier member grippable in a fixed angular position between the side flanges of the panel and a hanger member, mountable in a fixed angular position on the stringer, for supporting the carrier member beneath the stringer for unobstructed rotation relative to the stringer about a vertical axis, thereby to suspend the panel from the stringer at a selected angle.

8 Claims, 7 Drawing Figures

Fig. 2.
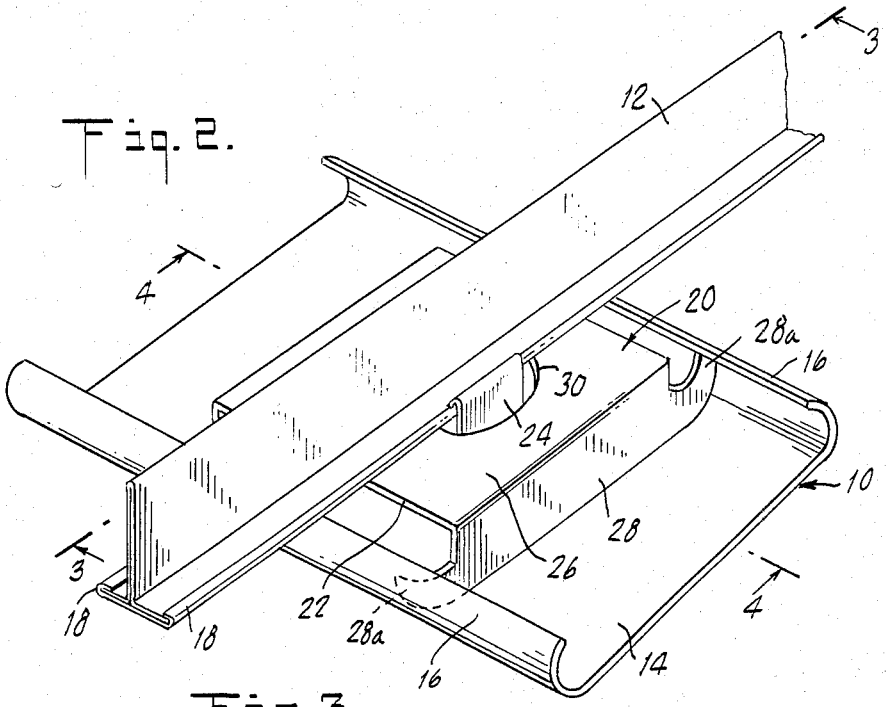
Fig. 3.
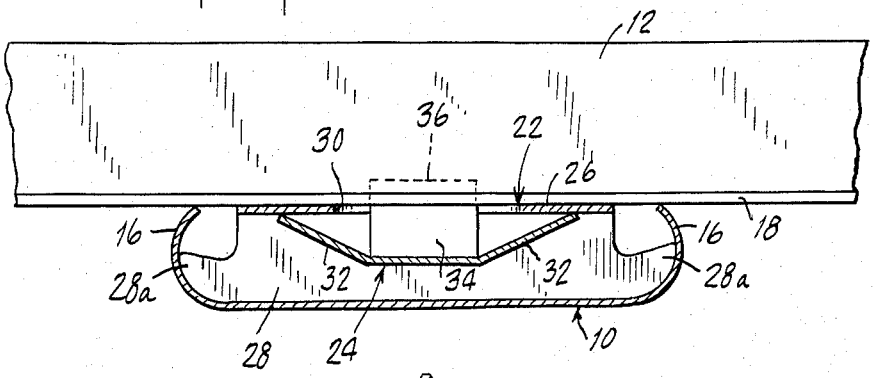
Fig. 4.
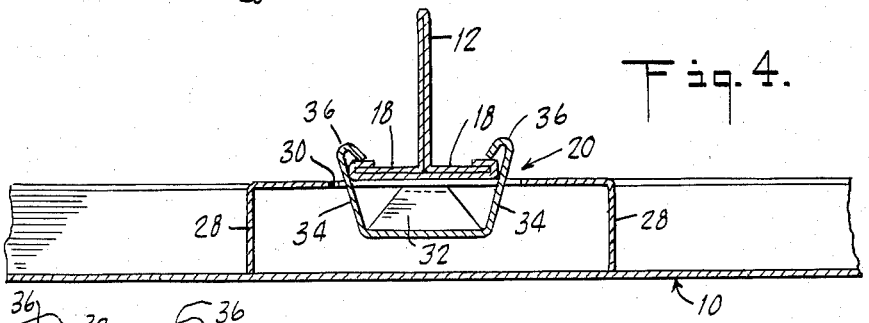
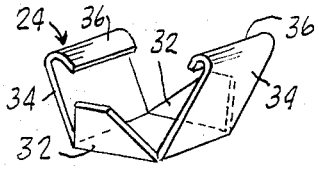
Fig. 5.

3/3

CEILING SYSTEM AND PANEL-SECURING DEVICE THEREFOR

BACKGROUND OF THE INVENTION

This invention relates to ceiling systems of the type wherein a plurality of spaced, elongated stringers cooperatively carry an array of horizontally elongated ceiling panels. More particularly, it is directed to devices for securing a panel to a stringer, as well as to ceiling systems including such devices.

One important application of the present invention, to which detailed reference will be made herein for purposes of illustration, is in suspended ceilings. A typical conventional subceiling or suspended ceiling is constituted of an array of ceiling panels spaced some distance below the true structural ceiling of a room. Commonly, the panels of the subceiling are supported by a plurality of stringers, which are elongated rigid members extending above the panels in spaced relation to each other and are themselves individually suspended from the structural ceiling by wires or rods located at intervals along their lengths. In an illustrative form of suspended ceiling, the ceiling panels are elongated metal or like resiliently deformable elements of upwardly opening C-shaped cross section, disposed in closely spaced parallel array with their downwardly-facing major surfaces in a common horizontal plane; the stringers supporting them are downwardly-opening horizontally elongated metal channel members each having a plurality of paired downwardly projecting seats on which the panels are snap-fitted. These stringers extend transversely of the panels, being individually suspended at a common elevation in widely spaced parallel relation to each other, so that each stringer supports a large number of the panels and each panel is supported by a plurality of the stringers.

Usually, in a conventional suspended ceiling of this type, as viewed in plan projection (i.e. as seen from vertically above or below, in projection on a horizontal plane), the long dimensions of the panels are perpendicular to the long dimensions of the stringers. For aesthetic or other reasons, however, it is sometimes desired to provide a nonparallel arrangement of ceiling panels, e.g. a converging array or a diamond or other geometric pattern. When the panels are not parallel to each other, at least some of them are necessarily oblique rather than perpendicular to the stringers as viewed in plan projection. This oblique orientation of the panels relative to the stringers precludes mounting of the panels on the conventional stringer seats, because the stringer seats are only able to hold panels oriented at one predetermined angle (viz. 90°) to the stringers. Expedients heretofore proposed for mounting ceiling panels in nonparallel arrangements have, in general, been limited as to the range of angles at which the panels can be oriented relative to the supporting stringers, with resultant inconvenience and restrictions on the type of panel arrangements that can be produced.

SUMMARY OF THE INVENTION

The present invention broadly contemplates the provision of a device for securing, at any desired angle to a horizontally elongated stringer, a subjacent horizontally elongated ceiling panel of upwardly opening C-shaped profile with resiliently deformable side flanges. In this broad sense, the device of the invention comprises a carrier member grippable between the side flanges of the panel in a fixed angular position relative thereto; and a hanger member, mountable on the stringer in a fixed angular position relative thereto, for supporting the carrier member beneath the stringer for unobstructed rotation relative to the stringer about a vertical axis, such that when the carrier member is gripped by the panel and the hanger member is mounted on the stringer, the panel is suspended from the stringer and can be oriented at any angle relative to the stringer as viewed in plan projection.

Advantageously, the carrier member includes a pair of seat portions respectively grippable between the side flanges of the panel at locations spaced along the length of the panel, for preventing angular displacement of the carrier member relative to the panel. As a further feature of the invention, the carrier member includes a web having the seat portions respectively disposed at opposite ends thereof and defining a circular hole disposed equidistantly from the seat portions; and the hanger member comprises a lower portion having opposed laterally extending legs for engaging the carrier member web from below at spaced locations outwardly of the hole, and an upper portion projecting upwardly from the legs for extending upwardly through the hole to engage the stringer above the carrier member while permitting unobstructed rotation of the carrier member relative to the hanger member about the aforementioned vertical axis. To provide a tight and positionally stable assembly, the hanger member legs are resiliently deformable and are shaped and positioned to press the carrier member web upwardly against the stringer when the hanger member is mounted on the stringer.

In one embodiment of the device of the invention, for use with a stringer of inverted-T profile with opposed longitudinal flanges, the upper portion of the hanger member comprises a pair of resiliently deformable arms for respectively hooking over the longitudinal flanges of the stringer and gripping the stringer between them along horizontally extended lines of contact. In another embodiment, the upper portion of the hanger member comprises a downwardly opening yoke for overlying the stringer in engagement therewith along opposed horizontally extended contact regions. The horizontally extended lines or regions of contact between the hanger member and stringer prevent angular movement of the hanger member relative to the stringer and thus contribute to positional stability.

The invention also embraces the combination, in a ceiling system, of at least two horizontally elongated stringers spaced apart at a common level; at least one horizontally elongated ceiling panel of upwardly opening C-shaped profile with resiliently deformable side flanges, extending beneath and transversely of the stringers; and a plurality of the above-described devices, respectively mounted on the stringers, for securing each panel to the stringers. The stringers of the system may be parallel to each other, with at least one panel oriented at an oblique angle to the stringers as viewed in plan projection.

Further features and advantages of the invention will be apparent from the detailed description hereinbelow set forth, together with the accompanying drawings.

BRIEF DESCRIPTION OF THE DRAWINGS

FIG. 2 is an enlarged perspective view, from above, of a portion of the ceiling assembly of FIG. 1, showing one embodiment of the invention;

FIG. 3 is a sectional view taken along the line 3—3 of FIG. 2;

FIG. 4 is a sectional view taken along the line 4—4 of FIG. 2;

FIG. 5 is a perspective view of the hanger member of the panel-securing device of FIGS. 2–4;

DETAILED DESCRIPTION

Figure 1:
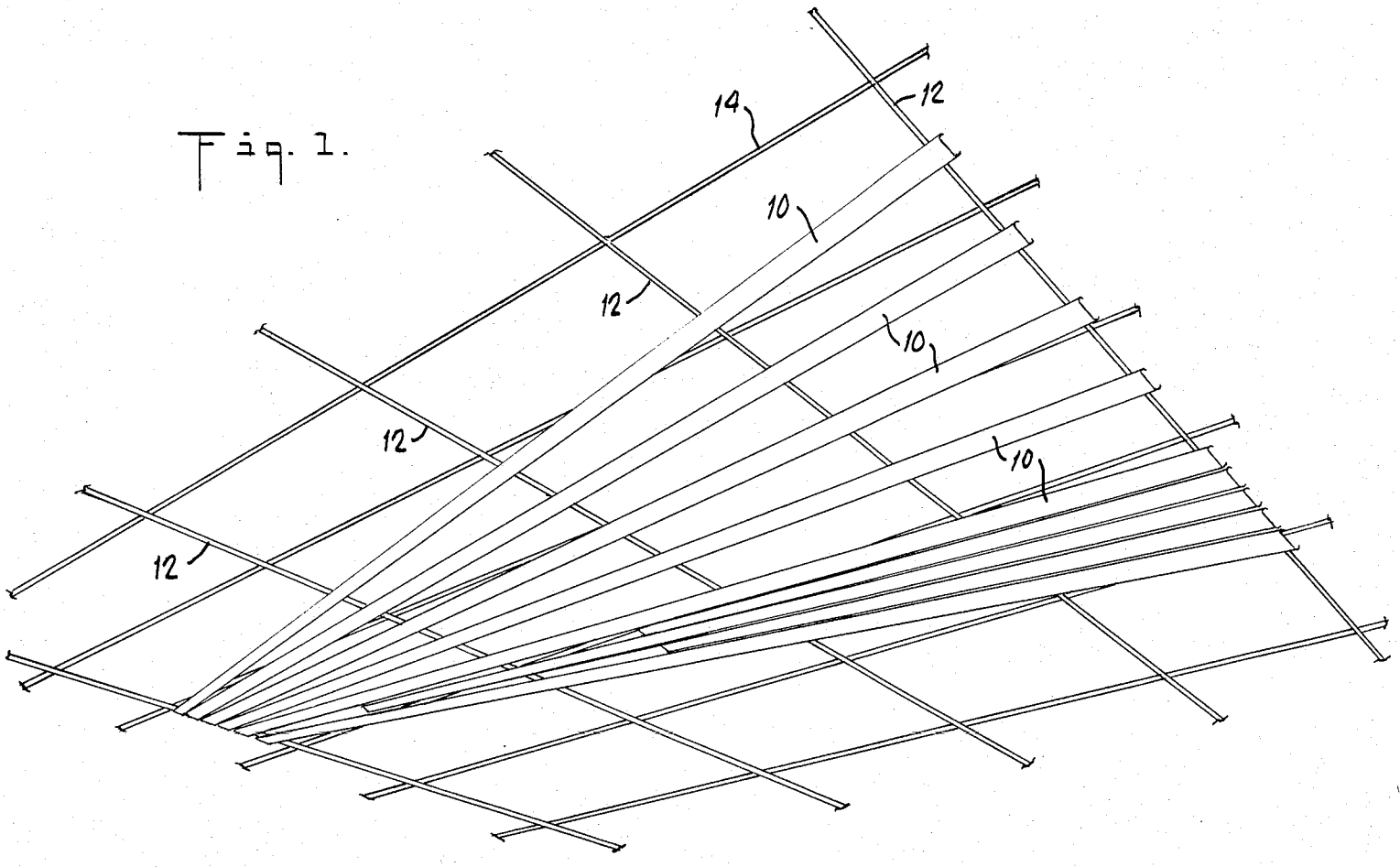
FIG. 1 is a perspective view, from below, of a ceiling assembly in which an embodiment of the invention may be incorporated.

Referring first to FIG. 1, there is shown a ceiling assembly comprising a plurality of horizontally elongated ceiling panels 10 carried by a plurality of horizontally elongated stringers 12 which extend in spaced parallel relation to each other beneath the structural ceiling (not shown) of a room, the stringers being themselves suitably supported as by means of cross members 14 secured to the room walls and/or suspended from the structural ceiling by suitable means (not shown), it being understood that the illustrated ceiling assembly is typically spaced some distance below the structural ceiling. In this assembly, the panels 10 are disposed in a converging array rather than being parallel to each other, and are therefore not perpendicular to the stringers 12 as viewed in plan projection. The term "stringers" is used herein to refer generically to rigid, elongated members extending above, and supporting, an array of ceiling panels, regardless of the particular cross-sectional configuration of such members.

As best seen in FIGS. 2–4, each of the panels 10 in the assembly of FIG. 1 is an elongated, roll-formed sheet aluminum member sufficiently rigid to be self-sustaining in shape, and having a broad, flat, central web 14 with opposed side flanges 16 that curve upwardly and inwardly toward each other so that the panel has an upwardly opening C-shaped profile or cross section. The flanges 16 are sufficiently resiliently deformable to enable the panel to be snap-fitted over seats or mounting projections (hereinafter described) and to grippingly engage these seats. Such panels are themselves entirely conventional and are widely used for suspended ceilings or subceilings as well as for other purposes. It will be understood that the term "C-shaped profile," as used herein, also embraces panels of specifically different configuration from that shown, such as panels having ribs formed in their central web portions and/or having generally planar side flanges with inwardly bent upper edges rather than continuously curved flanges.

Each of the stringers 12, in the ceiling assembly shown in FIGS. 2–4, is an inverted metal T-bar having opposed lateral flanges 18. Each stringer extends above and generally transversely of (though, in the assembly of FIG. 1, not perpendicular to) a plurality of the subjacent panels 10, and each panel 10 extends beneath a plurality of the spaced parallel stringers.

In accordance with the invention, each of the panels 10 is secured to each of the stringers 12 by a device 20, a separate device 20 being disposed at each intersection of a stringer and a panel. Each device 20 comprises a carrier member 22 grippable between the side flanges 16 of a panel 10 in a fixed angular position relative thereto, and a hanger member 24 which is mountable on a stringer 12 in a fixed angular position relative thereto for supporting the carrier member 22 beneath the stringer.

More particularly, and further in accordance with the invention, each carrier member 22 is a formed rigid metal member having a rectangular flat horizontal web 26 and opposed side flanges bent downwardly at 90° to the web to constitute two panel-mounting seat portions 28.

Each of these seat portions 28 has a configuration which is generally conventional for seats for C-shaped panels; i.e., each seat portion 28 is a downward projection having opposed lateral prongs 28*a* shaped and arranged to be gripped simultaneously by the opposed side flanges 16 of a panel 10. The two seat portions 28 are parallel to each other, being spaced apart by the width of the web 26, and are in register with each other so that they can both be gripped between the side flanges of a panel, thus providing for each carrier member two locations (spaced along the length of the panel) at which the carrier member is grippingly engated by the panel. Consequently, the carrier member 26, when gripped between the side flanges of a panel 10 as shown in FIG. 2, is fixed in angular orientation relative to the panel, being disposed with the long dimensions of the seat portions 28 perpendicular to the long dimension of the panel. This fixed angular relation between the carrier member and the panel secures the panel tightly to the carrier member and prevents dislodgment of the panel from the carrier member by angular displacement of the carrier member relative to the carrier.

A circular hole 30 is formed at the center of the web 26, equidistant from the two seat portions 28, to accommodate the hanger member 24 which, in the embodiment of FIGS. 2–5, is a unitary formed metal member having a lower portion comprising two upwardly diverging legs 32 and an upper portion comprising two arms 34 each terminating at its upper extremity in a hook-shaped edge 36. The hanger member shown is formed by cutting and bending a flat sheet metal body, the legs 32 being positioned at right angles to the arms 34. This member is so shaped and dimensioned that when the arms 34 are inserted upwardly through the hole 30 in the carrier member web 26, the legs 32 engage the downwardly facing surface of the web 24 at diametrically opposed locations outwardly of the hole 30.

The arms 34 are so arranged that their respective hook portions 36 can simultaneously overlie and engage the two lateral flanges 18 of a stringer 12, thereby to mount the hanger member on the stringer. In this mounted position, the two arms 34 engage the opposed flanges 18 of the stringer 12 along horizontally extended lines of contact so as to hold the hanger member in a fixed angular position relative to the stringer 12.

As best seen in FIGS. 3 and 4, when the hanger member 24 is disposed with its legs 32 engaging the lower surface of the carrier member web 26 and with its arms 34 projecting upwardly through the hole 30 into mounting engagement with the stringer 12, the legs 32 (which are resiliently deformable) press the carrier member web upwardly against the stringer 12, it being understood that this relationship is achieved by appropriate dimensioning of the hanger member legs and arms. Thereby, the device 20 is positionally stabilized relative to the stringer 12. Nevertheless, as thus mounted, the carrier member 22 is capable of unobstructed rotation (i.e. through a full 360 degrees) relative to the stringer 12 about a vertical axis. This enables a panel 10 (gripping the carrier member) to be suspended from the stringer 12 by means of the device 20 in any desired angular orientation relative to the stringer as viewed in plan projection.

To facilitate mounting of the devices 20 on the stringers, the hanger member arms 34 (which are resiliently spreadable), when unstressed, have their upper extremities spaced apart by a distance smaller than the combined width of the two flanges 18 of a stringer; their hook portions 36 can be forced upwardly, from below, past the stringer flanges, with lateral spreading of the arms, and then as the edges of the hook portions rise above the stringer flanges they snap into the position shown in FIG. 4 in which they positively engage the stringer flanges to lock the device 20 in place. The hole 30 is of sufficient diameter to accommodate the aforementioned lateral spreading of the arms 34.

The installation of the described ceiling system may now be readily understood. With the stringers 12 secured at a desired level in a room, each device 20 is installed manually on a stringer by inserting the arms 34 of the hanger member upwardly through the hole 30 of the carrier member and, with the device thus assembled, pushing the hanger member upwardly to force the hook portions 36 of the arms 34 over the flanges 18 of a stringer, thereby mounting the device on the stringer. The carrier member 22 is rotated to a position approximately corresponding to the desired orientation of the panel to be carried thereon (i.e. to a position in which the long dimensions of the seat portions 28 are perpendicular, in a horizontal plane, to the desired orientation of the long dimension of the panel) and the panel, held in the selected orientation, is forced upwardly into snap-fitting engagement with the seat portions. This procedure is continued until all the panels are secured to all the stringers by the devices 20 which, as stated, are ordinarily provided at each intersection of a panel and a stringer.

Owing to the unobstructed (360°) rotatability of the carrier member 22 of each device 20 about a vertical axis, each panel 10 can be positioned at any desired angle relative to the stringers, as viewed in plan projection. Once a panel has been snap-fitted onto two or more of the devices 20 (i.e. onto the devices 20 mounted on two or more stringers), it is positively held against displacement out of that angular orientation. As shown in FIG. 1, the device of the invention readily permits installation of panels at different angles to each other and with variation in interpanel spacing, on a conventionally arranged grid of parallel, equidistantly spaced stringers.

Figure 6:
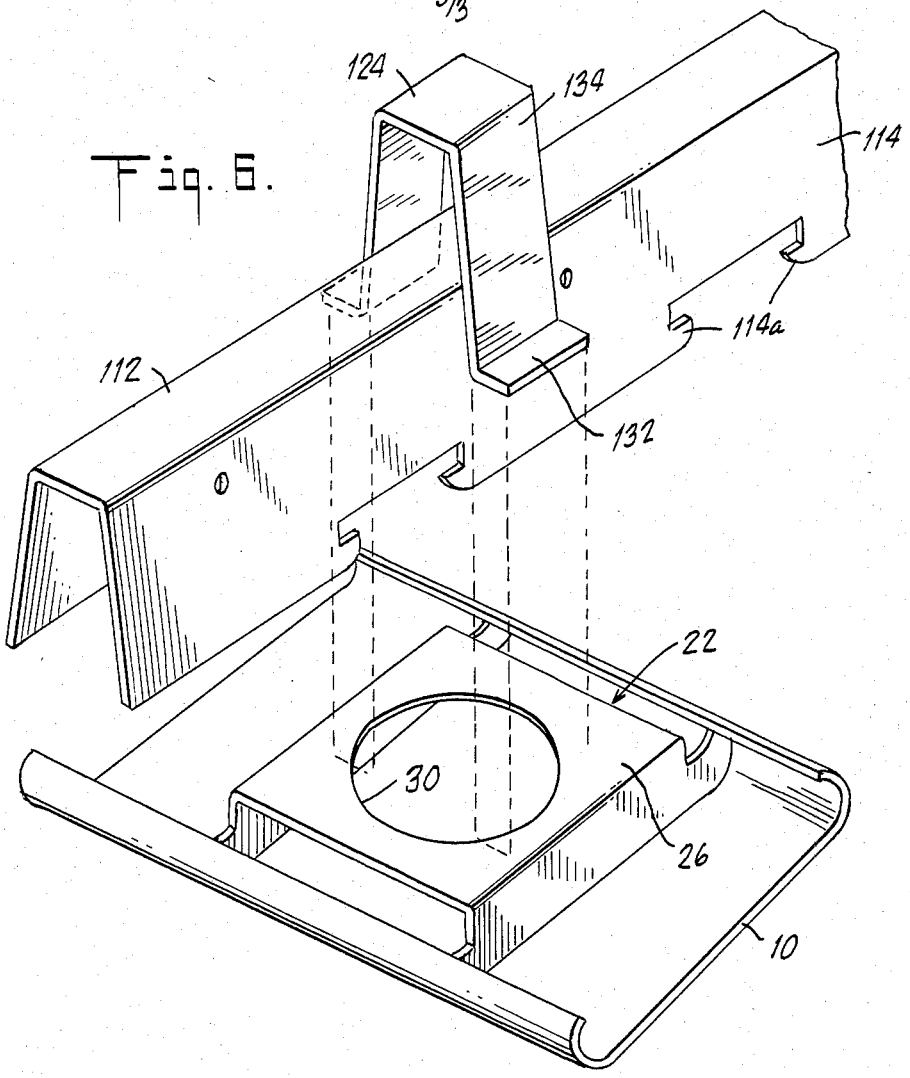
FIG. 6 is an exploded fragmentary perspective view, from above, of a ceiling system incorporating another embodiment of the invention.
Figure 7:
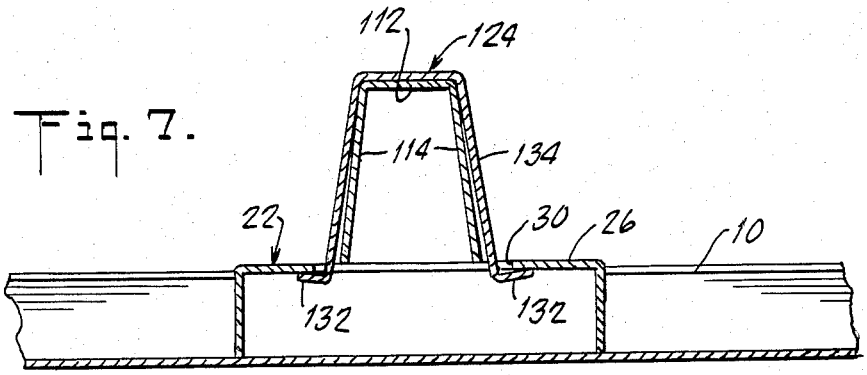
FIG. 7 is a sectional elevational view of the embodiment of FIG. 6.

The alternative embodiment of the invention shown in FIGS. 6 and 7 is arranged to adapt conventional suspended ceiling stringers 112 for use to support panels 10 at any desired angular orientation relative thereto. Each stringer 112 is a downwardly opening metal channel member with diverging legs 114, the bottom margins of the legs being typically cut out to form a succession of panel seats 114*a* which, however, are not employed to mount panels in the present system.

Each panel-securing device of the system of FIGS. 6 and 7 includes a carrier member 22 essentially identical to that of the embodiment of FIGS. 2–4, and a formed sheet metal hanger member 124 having legs 132 for engaging the lower surface of the carrier member web 26 at diametrically opposed locations outwardly of the hole 30. The upper portion 134 of the hanger member 124, projecting through and above the hole 30, is a downwardly opening yoke dimensioned to snugly overlie the channel-shaped stringer 112 in contact with the stringer outer surface along opposed, horizontally elongated contact regions such that the hanger member, when mounted on the stringer, is fixed in angular position relative thereto as desired for positional stability. The legs 132, formed at the lower extremities of the arms of the yoke, are resiliently deformable, the hanger member 124 being so dimensioned that when it is mounted on a stringer 112 the legs 132 urge the carrier member web upwardly against the stringer (FIG. 7). As in the case of the device 20 of FIGS. 2–4, the carrier member 22 is supported by the hanger member for unobstructed rotation relative to the stringer about a vertical axis, to enable orientation of a panel 10 at any selected angle (as viewed in plan projection) relative to the stringer. The described panel-securing device of FIGS. 6 and 7 thus functions in the same manner as that of FIGS. 2–4, differing therefrom only in being arranged for mounting on a different type of stringer.

It is to be understood that the invention is not limited to the features and embodiments hereinabove specifically set forth, but may be carried out in other ways without departure from its spirit.

I claim:

1. A device for securing, to a horizontally elongated stringer, a subjacent horizontally elongated ceiling panel of upwardly opening C-shaped profile with resiliently deformable side flanges, comprising (a) a carrier member grippable between the side flanges of the panel in a fixed angular position relative thereto; and (b) a hanger member, mountable on the stringer in a fixed angular position relative thereto, for supporting the carrier member beneath the stringer for unobstructed rotation relative to the stringer about a vertical axis, such that when the carrier member is gripped by the panel and the hanger member is mounted on the stringer, the panel is suspended from the stringer and can be oriented at any desired angle relative to the stringer as viewed in plan projection.

2. A device as defined in claim 1, wherein the carrier member includes a pair of seat portions respectively grippable between the side flanges of the panel at locations spaced along the length of the panel, for preventing angular displacement of the carrier member relative to the panel.

3. A device as defined in claim 2, wherein said carrier member further includes a web having said seat portions respectively disposed at opposite ends thereof and defining a circular hole disposed equidistantly from said seat portions, and wherein said hanger member comprises a lower portion having opposed laterally extending legs for engaging said web from below at spaced locations outwardly of said hole and an upper portion projecting upwardly from said legs for extending upwardly through said hole to engage the stringer above said carrier member while permitting unobstructed rotation of said carrier member relative to said hanger member about said vertical axis.

4. A device as defined in claim 3, wherein said hanger member legs are resiliently deformable and are shaped and positioned to press said web upwardly against the stringer when the hanger member is mounted on the stringer.

5. A device as defined in claim 3 or 4, for use with a stringer of inverted-T profile with opposed longitudinal flanges, wherein said upper portion of said hanger member comprises a pair of resiliently deformable arms for respectively hooking over the longitudinal flanges of the stringer and gripping the stringer between them along horizontally extended lines of contact.

6. A device as defined in claim 3 or 4, wherein said upper portion of said hanger member comprises a downwardly opening yoke for overlying the stringer in engagement therewith along opposed horizontally extended contact regions.

7. In a ceiling system, in combination, (a) at least two horizontally elongated stringers spaced apart at a common level;

(b) at least one horizontally elongated ceiling panel of upwardly opening C-shaped profile with resiliently deformable side flanges, extending beneath and transversely of said stringers; and (c) a plurality of devices, respectively mounted on said stringers for securing said one panel to said stringers, each said device comprising (i) a carrier member gripped between the side flanges of said one panel in a fixed angular position relative thereto; and (ii) a hanger member, mounted on one of the stringers in a fixed angular position relative thereto, for supporting the carrier member beneath the last-mentioned stringer for unobstructed rotation relative to the last-mentioned stringer about a vertical axis, such that the panel is suspended from the stringer.

8. A system as defined in claim 7, wherein said stringers are parallel to each other and said one panel is oriented at an oblique angle to the stringers as viewed in plan projection.

* * * * *